US006183559B1

(12) United States Patent
Mentone et al.

(10) Patent No.: US 6,183,559 B1
(45) Date of Patent: Feb. 6, 2001

(54) ROTATABLE COATING HOPPER

(75) Inventors: James P. Mentone, Lincoln Park, NJ (US); William R. Millard, Westlake Village, CA (US); David C. De Palma, Pen Argyl, PA (US)

(73) Assignee: Building Materials Corporation of America, Wayne, NJ (US)

( * ) Notice: Under 35 U.S.C. 154(b), the term of this patent shall be extended for 0 days.

(21) Appl. No.: 09/237,732

(22) Filed: Jan. 26, 1999

(51) Int. Cl.[7] ..... B05B 7/26

(52) U.S. Cl. ..... 118/311; 118/304; 118/308; 118/310; 118/319

(58) Field of Search ..... 118/304, 308, 118/310, 311, 319, 324

(56) References Cited

U.S. PATENT DOCUMENTS

| | | | | |
|---|---|---|---|---|
| 3,783,957 | * | 1/1974 | Borghi | 177/54 |
| 3,908,591 | * | 9/1975 | Hall | 118/308 |
| 4,356,216 | | 10/1982 | Gailey et al. | 427/286 |
| 4,550,680 | * | 11/1985 | Derendinger | 118/308 |
| 4,583,486 | | 4/1986 | Miller | 118/308 |
| 4,595,128 | * | 6/1986 | Fielding | 222/252 |
| 5,534,114 | | 7/1996 | Cutright et al. | 162/139 |
| 5,746,830 | * | 5/1998 | Burton et al. | 118/308 |

* cited by examiner

*Primary Examiner*—Shrive Beck
*Assistant Examiner*—Jennifer Calcagni
(74) *Attorney, Agent, or Firm*—Imre Balogh; William J. Davis

(57) ABSTRACT

Apparatus and process for coating a continuously advancing web with a dry or wet coating material on a conveyor belt. The apparatus having a hopper which contains an agitator, a brush and a knurled roll to accurately dispense the coating material to an applicator which is positioned on a carousel. By rotating the carousel, the coating in the form of stripes, bars or a uniform layer can be varied at angles 0° to 90° on the continuously advancing web.

1 Claim, 6 Drawing Sheets

ROTATABLE COATING HOPPER

BACKGROUND OF THE INVENTION

1. Field of the Invention

This invention relates to an apparatus and a process for producing coatings on multi-width sheets or webs using wet or dry materials in the coating process. More particularly, the invention relates to a rotatable coating hopper for depositing coating materials on sheets or webs for producing roofing sheets or shingles.

2. Reported Developments

It is well known in the prior art in the field of building materials to coat roofing sheets and shingles for protection against the elements and/or for rendering a pleasing appearance to such sheets and shingles. Typically, the coating comprises asphalt and a granular or powder material which is deposited on the molten asphalt. When the asphalt cools, the granular or powder material becomes embedded therein. Various apparata and processes are used to produce the coated sheets or shingles illustrative of which are the following.

U.S. Pat. No. 3,730,397 discloses a granules applicator for applying granular material to sheets of roofing material.

The granular applicator unit comprises a granule hopper which is located well above a horizontal path along which a sheet moves continuously during the application of the granules. A cavity roll, having one cavity, is located directly under the hopper and drives a belt that is carried by idler rolls. There are three idler rolls which hold the belt against the cavity roll. A distribution roll is located under the third idler roll and directly above the moving sheet. A deflector gate, associated with the distribution roll, provides a distribution gate for the granules which fall onto the sheet in a uniform layer. The pattern of distribution is limited to one single pattern since the cavity roll has only one cavity therein.

In order to vary the pattern of the granules applied, the patentee suggests using a number of such units to be used in tandem. However, even if several of these units were used in tandem, the pattern that could be created would run only laterally to the longitudinal direction of the sheet of roofing material.

U.S. Pat. No. 4,356,216 discloses a process for producing striped surface coatings such as used to create a pattern simulating the appearance of natural wood grain. The process includes the following steps.

A first liquid coating material, such as a paint, is applied to a strip surface; then a second coating material is delivered through one or more apertures onto the painted strip surface. The apertures are provided in a rotatable disk. Rotary movement of the disk angularly displaces the apertures so as to vary the location and spacing of the produced stripes.

U.S. Pat. No. 4,583,486 discloses an apparatus for depositing granules on a moving sheet. The apparatus is positioned above a moving sheet which travels laterally to the apparatus. The apparatus comprises:

- a hopper having an open area at its bottom portion is designed to receive granules;
- a perforated belt adapted to close the open area in the bottom portion of the hopper; and
- motor means to drive the belt in one direction only; whereby granules received by the hopper drop through the perforations in the belt and are deposited on the moving sheet.

By changing the angle between the moving sheet and the perforated belt and adjusting their speed of travel the pattern of deposition may be varied.

U.S. Pat. No. 5,382,291 discloses an apparatus for making decorations on tarred membranes for surface covering in the construction industry.

The apparatus comprises:

- a hopper which contains solid particles in the form of scales, sands or granules; and
- an applicator for applying the solid particles in a decorative pattern. The applicator is positioned below the hopper and includes a rotating roller, or a rotating ring-wound continuous belt or a rotatable plate each of which have a replaceable skin covering the same, the skin having cut-ins of the decorative pattern intended to be transferred onto a tarred surface.

The process of producing decorative pattern on a tarred surface is as follows. First, a membrane intended for use in the building industry is tarred in an impregnation bath which contains the hot tar. The tarred membrane travels on a continuous belt toward the applicator which is fed from the hopper containing the solid particles. The solid particles fall, by gravity, onto the rotating roller, or on a ring-wound continuous belt, or on a rotatable plate each of which has the desired decorative pattern. By rotation, the solid particles are dumped onto the tarred membrane on which they assume the same pattern as they had on the rotating roller. Subsequently, the tarred membrane with the decorative pattern thereon is dried and packaged.

If desired, a layer of grit may be deposited on the tarred and decorated membrane prior to the drying step. The deposition of grit is accomplished by an applicator similar to that used to deposit the pattern, but without the rotating roller having any design cut into the skin covering the rotating roller.

U.S. Pat. No. 5,534,114 discloses a method and apparatus for applying a fluid material to a web.

The apparatus for applying a fluid material to a substrate comprises:

- means for moving a substrate along a first path;
- means for moving an orifice along a second endless path, the orifice crossing the first path; and
- a housing assembly comprising:
  - means for retaining a supply of fluid material alone in the second path portion and under pressure; and
  - means for communicating the retained supply of fluid material under pressure with the orifice which it moves along the second path as the fluid material is discharged continuously and transversely upon the substrate.

The bands produced by the apparatus can be perpendicular to web travel; the width of the bands can be increased by increasing the slurry supply; and the angle of the bands can be changed by altering the pivot of the moving orifice applicator.

The prior art devices and processes do not adequately provide for the production of multi-width products and coatings; and for production of patterns that can be in the machine direction, or perpendicular to machine direction, or any angle between machine direction and perpendicular to the machine direction.

The present invention is directed to solve these shortcomings of the prior art.

SUMMARY OF THE INVENTION

In accordance with the present invention there is provided an apparatus and a process for coating a continuously advancing web with a dry or a wet coating material.

The apparatus comprises: a carousel, or turn table, rotatable from 0° to 90° angles around its vertical center axis; an applicator having an applicator port therein for discharging the coating material to the web; and a hopper positioned over and associated with the carousel and rotatable therewith for the containment and delivery of the coating material to the applicator. The apparatus is positioned over a continuously advancing conveyor belt which carries the web in a longitudinal direction. The applicator through its discharge port deposits the coating material in the form of stripes, bars or a uniform layer onto the web forming a coating thereon.

The hopper preferably contains three rotating devices, e.g., rolls, therein for sifting the coating material and delivering it to the applicator: an agitator in the upper portion of the hopper for stirring the coating material and maintaining it in a fluid, uncoagulated condition; a brush positioned downward from the agitator for receiving the coating material from the agitator; and a knurled roll which contacts and rubs against the brush and carries the coating material out of the applicator. The brush contains bristles between which the coating material is dispersed. The bristles bend when rubbing against the knurled roll resulting in the release of the coating material.

The apparatus also includes feeding chutes positioned over the hopper for continuous delivery of the coating material into the hopper.

In accordance with the present invention, a process for producing coatings on a continuously advancing web designed for shingles and sheets used in the building materials industry is also provided. The web is typically precoated with a hot-melt material, such as asphalt, prior to being subjected to the coating process of the present invention. Pre-coating is accomplished in a hot bath containing the hot melt material and is well-known in the prior art. Such pre-coating is preferable when dry coating materials, such as granules, are used so as to imbed the granules in the hot melt coated web. The pre-coated web is then coated by the process of the present invention comprising the steps of: feeding the hopper with the desired coating material; allowing the coating material to pass through the discharge port and be deposited on the continuously advancing web to form stripes, bars or a uniform layer thereon. The separation or width of the stripes, bars or uniform layer can be varied by rotating the carousel between 0° and 90°.

DETAILED DESCRIPTION OF THE INVENTION

Figure 1:
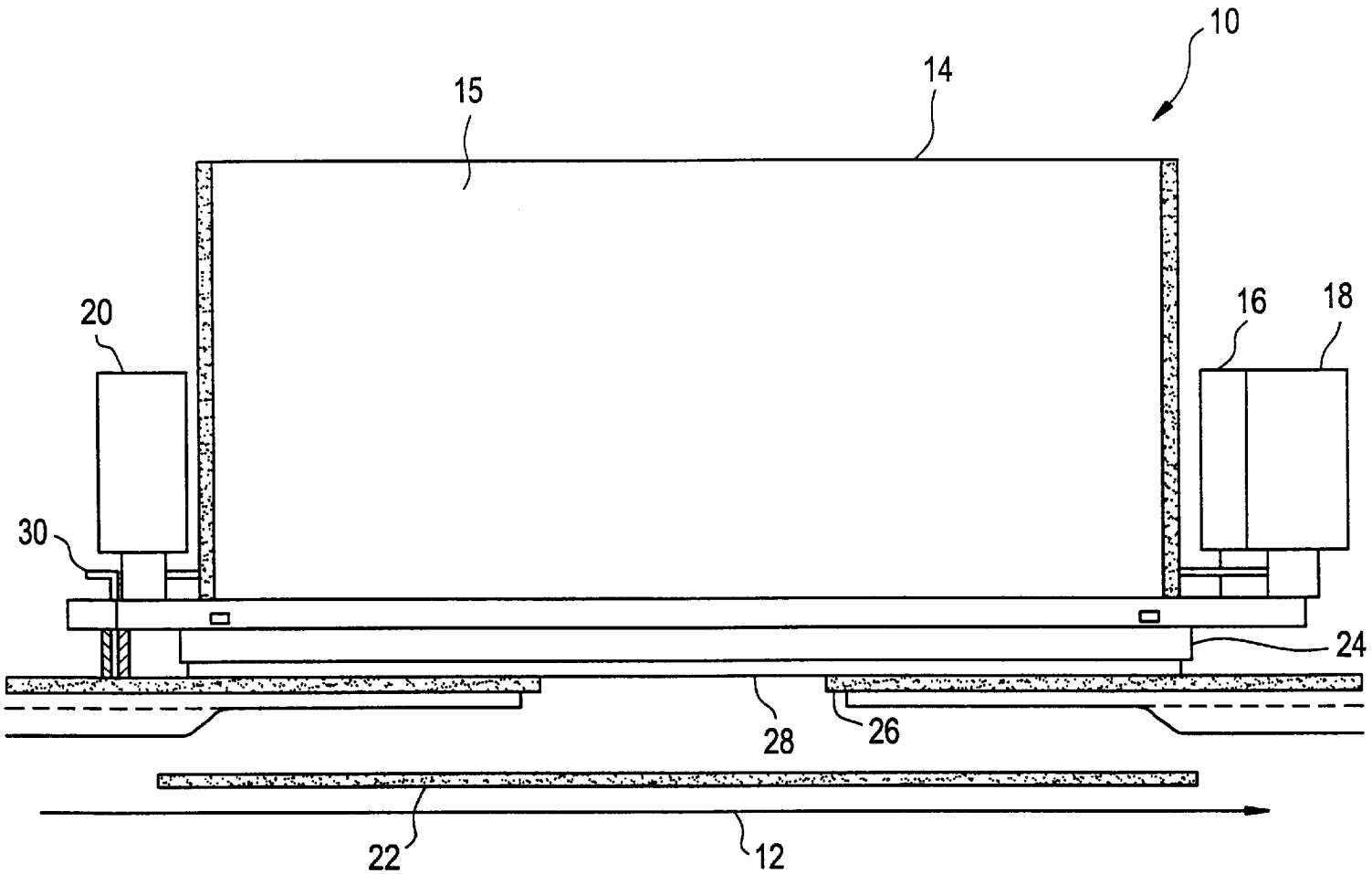
FIG. 1 shows the rotatable coating hopper apparatus in fragmentary front-elevational view.

The rotatable coating hopper apparatus is shown in a fragmentary front-elevational view in FIG. 1 designated by the numeral 10. The components of the apparatus include hopper 14 positioned on top of carousel 24. Carousel 24 includes applicator 26 with discharge port 28 in the center thereof. Motors 16, 18 and 20 associated with carousel 24 and hopper 14 provide the necessary turning movements the description of which follows as the invention is being described and illustrated in subsequent Figures. The carousel is positioned over, and without contact with, sheet or web 22 which is to be coated. The web travels on conveyor belt 12 the speed of travel of which can be controlled as desired. The position of rotatable coating hopper apparatus 10 can be at any angle between 0° and 90° with respect to the horizontal plane of conveyor belt 12. Once a position of rotatable coating hopper apparatus 10 is set as desired, locking pin 30 maintains the set position.

Figure 2:
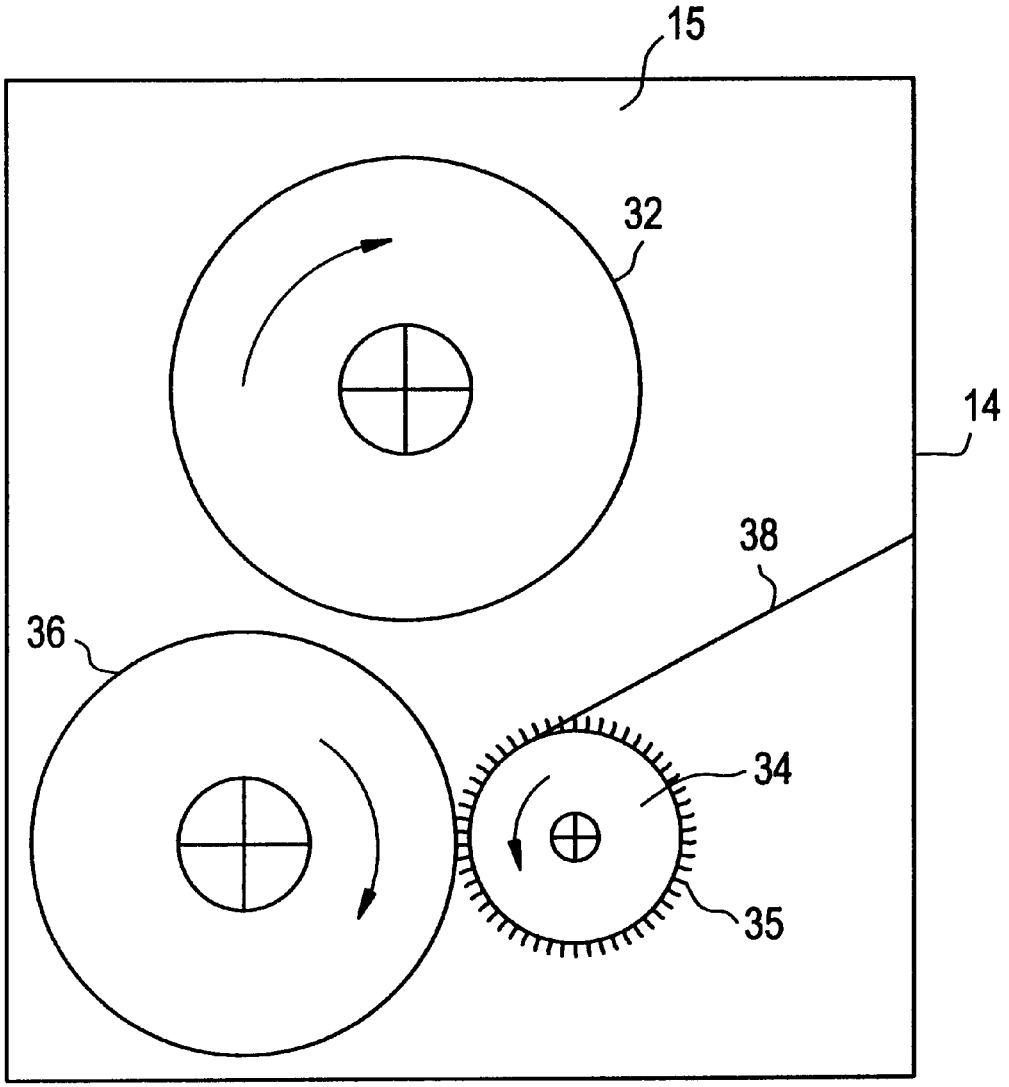
FIG. 2 is a schematic representation of the internal components of the hopper containing an agitator roll, a brush roll and a knurl roll.

FIG. 2 is a schematic representation of the internal components of hopper 14 containing three rolls: agitator roll 32, brush roll 34 and knurled roll 36. The hopper receiving granules 15 from a feeding source maintains the granules and delivers them to the applicator 26 through discharge port 28. Agitator roll 32 turning, e.g., in clock-wise direction, agitates granules 15, or other material intended as a coating for web 22, in a fluid, uncoagulated state. Agitator roll 32 is positioned in the upper portion of hopper 14 while brush roll 34 and knurled roll 36 are positioned in the lower portion of the hopper underneath the agitator roll. Granules 15 reach brush roll 34 in a homogeneous, uncoagulated state. Brush roll 34 turning in counter-clock-wise direction carries the granules between its bristles 35 which rub against knurl roll 36 which turns in clock-wise direction. Knurled roll causes the bristles of the brush roll to bend and then straighten and thereby releases the granules towards the discharge port 28. Shield 38 slightly contacts the bristles of brush roll 34 to prevent caking of the granules between the bristles. All three rolls may run with variable speed in order to provide for various rates of delivery of the granules.

Figure 3:
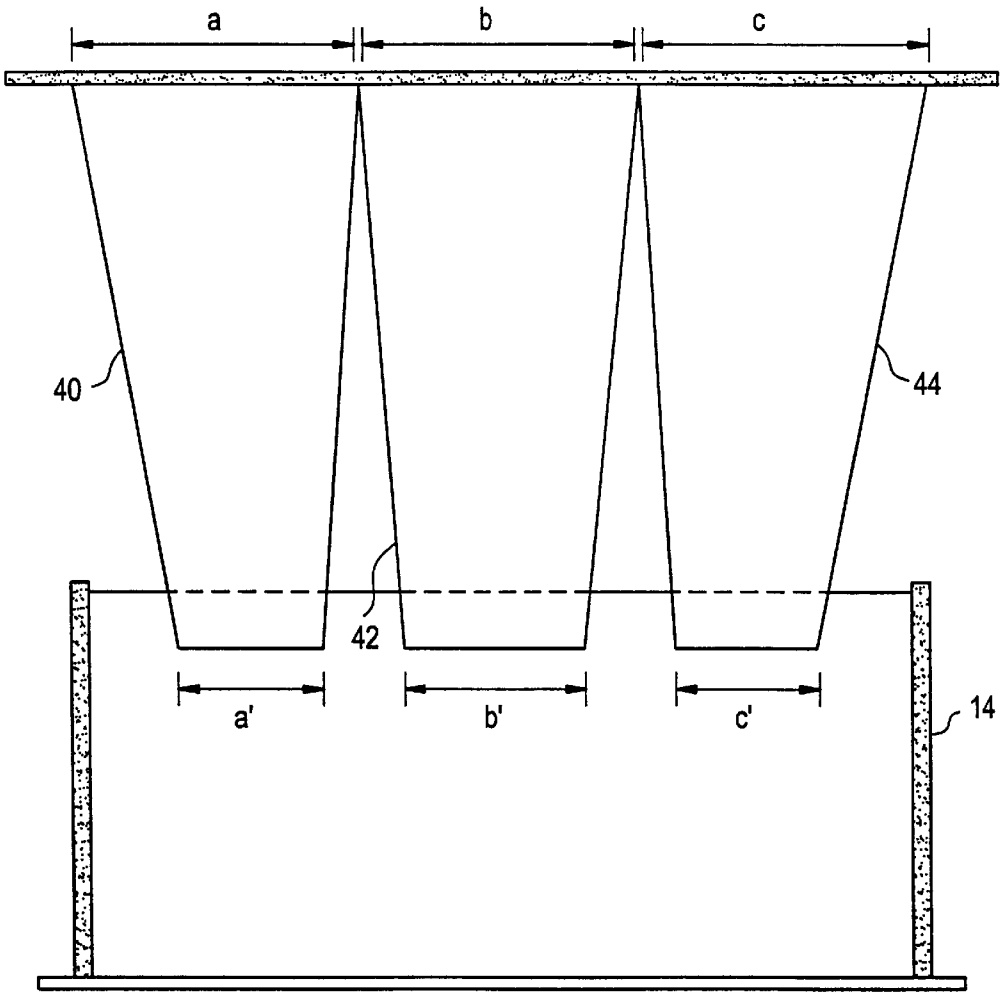
FIG. 3 shows a front elevational view of multiple material delivery chutes positioned over the hopper.
Figure 4:
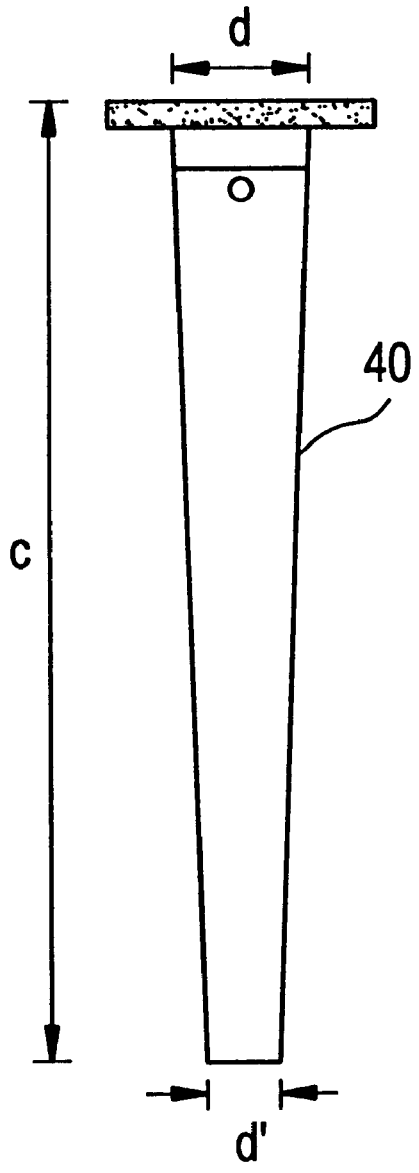
FIG. 4 shows a side elevational view of one chute.

Referring to FIGS. 3 and 4, hopper 14 is supplied with granules 15 from chutes 40, 42 and 44. FIG. 3 shows a front elevational view of the chutes and FIG. 4 shows a side elevational view of chute 40. Dimensions of the chutes may be varied as desired. Exemplary dimensions of the chutes are: top front widths designated a, b and c, each of which is about 10" to 12"; bottom front widths a', b' and c', each of which is about 7" to 9"; side front top width d of each chute is about 2.5" to 3.5"; side front bottom width d' of each chute is about 1.5" to 2.5"; and vertical height e of each chute is about 21" to 23".

The chutes are stationary and are secured over the hopper. The amount of granules delivered into the chutes may also be regulated by a metering means (not shown).

Figure 5:
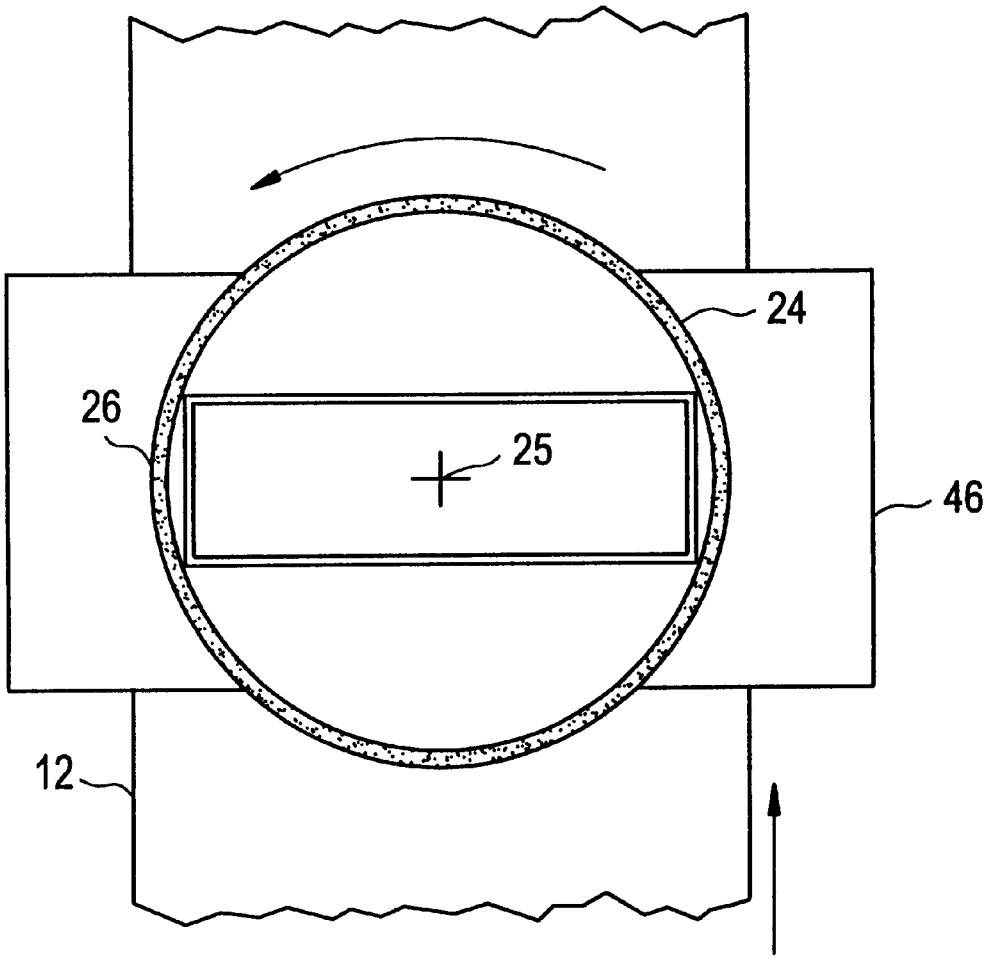
FIG. 5 shows a top schematic view of a carousel, an applicator and a conveyor belt in their functionally cooperating relationship to each other.

FIG. 5 shows a top schematic view of carousel 24, applicator 26 and conveyor belt 12. Carousel 24 is mounted on mounting plate 46. Applicator 26 positioned under carousel 24 is shown at 0° angle. In this position the applicator deposits the granules in a lateral or width direction on conveyor belt 12. Moving the turn table in counter-clockwise direction indicated by the arrow, applicator 26 will be at an angle larger than the 0° angle.

Figure 6:
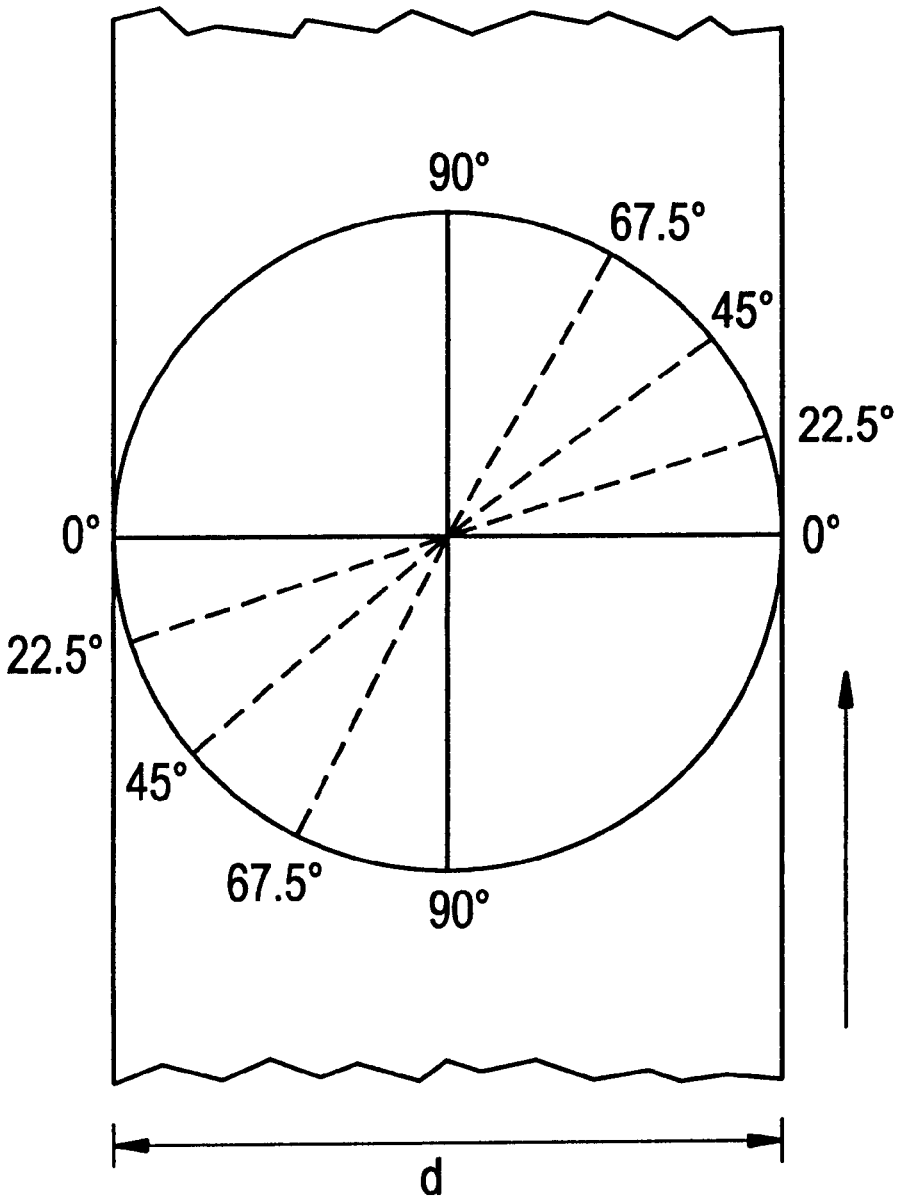
FIG. 6 illustrates the deposition of coating materials, such as granules, at various angles with respect to the longitudinal direction of the conveyor belt.

FIG. 6 illustrates the direction of deposition of granules at various angles with respect to the longitudinal direction of conveyor belt 12.

Referring to FIGS. 1–6, the invention will be described as embodied in a process for continuously coating one surface of web 22 which is carried by conveyor belt 12. The coating material may be dry granular material or a liquid, such as paint. The coating covers one entire surface of the web except for narrow longitudinal edges of the web. If the coating material is a dry granular material, the web can be pre-coated with a hot, semi-solid adhesive such as asphalt, to provide for adhesion of the granular particles to the web upon cooling and drying the web. The process begins by activating motor 16, 18 and 20. Simultaneously to the activation of the motors, feeding of chutes 40, 42 and 44 with the desired coating material begins which coating material is delivered to the hopper. In the hopper the coating material reaches agitator roll 32 which maintains the coating material in an uncoagulated state. The coating material is deposited onto brush roll 34 which carries it between its bristles 35 to knurled roll 36 which deposits it on applicator 26. The applicator through discharge port 28 deposits the material onto the web in a direction which was pre-set at the start of the process. The pattern can be changed by adjusting the angle of applicator 26. When the applicator is stationary, and is oriented as shown in FIG. 5 with the discharge port aligned in a horizontal line perpendicular to the direction of advance of web 22, the ridges or stripes are in a width direction. If during the advance of web 22 and continuous deposition of granules 15 to hopper 14, the carousel 24 is rotated about its axis, discharge port 28 in applicator 26 is angularly displaced about the axis resulting in a change in the direction and spacing of the coating ridges or stripes. Continuous rotation of the carousel results in ridges or stripes from width to longitudinal directions. The continuous or intermittent rotation may also be accomplished by the use of a programmed computer.

| PARTS LIST | |
|---|---|
| Rotatable coating hopper apparatus | 10 |
| Conveyor belt | 12 |
| Hopper | 14 |
| Granules | 15 |
| AC Motors | 16, 18 & 20 |
| Sheet or web | 22 |
| Carousel or turntable | 24 |
| Axis of carousel | 25 |
| Applicator | 26 |
| Discharge port in applicator | 28 |
| Locking pin | 30 |
| Agitator roll | 32 |
| Brush roll | 34 |
| Bristles on brush roll | 35 |
| Knurl roll | 36 |
| Shield | 38 |
| Chutes | 40, 42 & 44 |
| Mounting plate | 46 |

Having described the invention with reference to its preferred embodiments, it is to be understood that modifications within the scope of the invention will be apparent to those skilled in the art.

What is claimed is:

1. A rotatable coating apparatus for producing coatings in configurations of stripes and bars on a hot melt pre-coated web using a granular coating material comprising:

a carousel, rotatable from 0° to 180° angles around its vertical center axis enabling production of patterns on a hot melt pre-coated web in the machine direction, or perpendicular to the machine direction, or any angles between the machine direction and perpendicular to the machine direction, wherein said patterns are stripes, bars or a combination thereof;

an applicator having a discharge port therein affixed to said carousel for discharging a granular coating material onto said hot-melt pre-coated web;

a hopper positioned over and associated with said carousel and rotatable therewith for the containment and delivery of said granular coating material to said discharge port, said rotatable coating apparatus being positioned over said hot-melt pre-coated web being carried on a conveyor belt in a longitudinal direction under said discharge port and spaced therefrom to receive said granular coating material thereon, whereby the granular coating material received from said hopper drops through said discharge port and are deposited on said hot-melt pre-coated web forming a coating thereon;

said hopper containing three internal components therein an agitator roll positioned in the upper portion of the hopper, rotating in clockwise direction for maintaining said granular coating material in an uncoagulated condition, said granular coating material being delivered onto said agitator roll from a plurality of feeding chutes positioned over said hopper;

a brush roll, positioned in the lower portion of the hopper underneath the agitator roll, rotating in counter-clockwise direction, having bristles thereon for receiving said granular coating material from said agitator roll and carrying said granular coating material in dispersed and finely divided particulate form in interstices between said bristles; and a knurl roll, positioned in the lower portion of the hopper underneath the agitator roll and horizontally adjacent to said brush roll, rotating in clockwise direction in contacting relationship with said brush roll, for releasing said finely divided particulate coating material from the interstices between the bristles of said brush roll and depositing the finely divided particulates through the discharge port of said hopper onto said hot melt pre-coated web;

wherein said rotatable coating apparatus further includes activating motors in association with said hopper and said agitator roll, brush roll and knurl roll contained in said hopper to regulate the rate of deposition of said finely divided granular coating material onto said hot melt pre-coated web; and said applicator affixed to said carousel is capable of being rotated intermittently or continuously from 0° to 180° angles around its vertical center axis thereby producing coatings in the form of stripes and bars, spaced from each other, on said hot melt pre-coated web.

* * * * *